United States Patent [19]

Waldemar

[11] Patent Number: 4,551,700

[45] Date of Patent: Nov. 5, 1985

[54] TOROIDAL POWER TRANSFORMER

[75] Inventor: Anders Waldemar, Rottne, Sweden

[73] Assignee: Toroid Transformator AB, Växjö, Sweden

[21] Appl. No.: 589,693

[22] Filed: Mar. 14, 1984

[51] Int. Cl.[4] ..... H01F 15/10

[52] U.S. Cl. ..... 336/192; 174/138 E; 174/152 G; 336/229

[58] Field of Search ..... 336/229, 206, 192, 208; 174/167, 138 E, 152 G, 72 A

[56] References Cited

U.S. PATENT DOCUMENTS

| | | | |
|---|---|---|---|
| 2,243,553 | 5/1941 | D'Entremont | 336/206 X |
| 2,425,443 | 8/1947 | Soreng | 336/192 |
| 3,192,377 | 6/1965 | Abolins | 174/72 R X |
| 3,676,579 | 7/1972 | Lanoue et al. | 174/167 X |
| 4,384,167 | 5/1983 | Nestor | 174/72 A |

FOREIGN PATENT DOCUMENTS

| | | | |
|---|---|---|---|
| 713738 | 11/1941 | Fed. Rep. of Germany | 174/138 R |
| 2713117 | 9/1978 | Fed. Rep. of Germany | 336/208 |
| 305228 | 1/1933 | Italy | 336/208 |

*Primary Examiner*—Thomas J. Kozma
*Attorney, Agent, or Firm*—Staas & Halsey

[57] ABSTRACT

A toroidal power transformer having improved insulation between the primary and secondary windings. The insulation includes an insulator sleeve fitted to the primary winding and having the primary winding lead wires positioned therein such that the lead wires extend radially outward from the primary winding. This insulator sleeve is fitted to the primary windings by way of an insulator flange formed as an integral part of the insulator sleeve which insures good insulation between the primary and secondary windings and high creepage distance.

4 Claims, 7 Drawing Figures

TOROIDAL POWER TRANSFORMER

BACKGROUND OF THE INVENTION

The present invention relates to a power transformer of toroidal design, and more particularly to an improved means for providing high voltage insulation between the primary and secondary windings of such a toroidal power transformer and for maximizing the creepage distance; this distance being measured, for example, along the surface of the insulating material between the windings. Maximizing the creepage distance insures that the insulation material between the windings will maintain its integrity over a long period of time.

In toroidal power transformers, a primary winding (or set of primary windings) is first wound on a toroid shaped core, covering nearly the entire circumference of the core. One or more secondary windings are then wound on top of the primary windings, with a high-voltage insulating layer separating the primary and secondary windings for forming a safety insulation layer capable of withstanding high-voltage insulation testing and high operating potential differences between the primary and secondary windings.

The high-voltage insulating layer customarily comprises layers of polyester film strips wound on top of the primary winding such that each turn of the strip partly overlaps the prior turn. This kind of insulation provides excellent integrity against break through as well as good creepage distance. A problem in achieving a good creepage distance exists, however, were leads to the primary windings penetrate the insulation and the secondary windings.

There are basically two different procedures in use for assuring sufficient creepage distances and overall integrity of insulation around the primary leads in the region where the leads penetrate the insulation. FIG. 1 illustrates one approach to insure high creepage distance between the primary and secondary windings. This approach essentially comprises: after winding the primary and before adding the insulating layer, taping the primary winding in the area where the primary lead wires pass through the insulating layer. Because this taping involves hand operations, this approach results in a toroidal transformer that is difficult and more costly to manufacture. This approach, also is subject to manufacturing variations leading to transformer breakdown due to variations in the creepage distance caused by the hand taping. Moreover, once the secondary winding has been wound, there is no way of assuring that proper taping was accomplished so as to provide sufficient creepage distance.

In winding the primary shown in FIG. 1, the primary winding is begun at any point around the toroidal core, leaving a free portion of the wire for connection to a first lead wire. The wire is wound around the circumference of the toroidal core to a point adjacent the beginning winding, and leaving another free portion of the wire for connection to a second lead wire. The free portions can be self leads, in which case color-coded insulating sleeves are pulled over the primary leads, or separate insulated leads may be soldered on to the free portions of the primary winding. The solder joints can be insulated in any conventional way.

The creepage distance in a transformer wound as described above is achieved by manually placing insulating tape tangentially over the beginning and end wires of the primary winding. This insulating tape is placed underneath the insulated primary leads. Then, the polyester film strips are wound around the primary windings to form the insulating layer as shown. Next, both primary leads are placed in a separate insulating sleeve. This insulating sleeve is then slit at the end nearest the primary winding and the slit ends are taped to the insulating layer. Finally, the secondary windings are wound on top of the insulating layer and on the slit ends of the insulating sleeve. The secondary windings serve to further mechanically hold the insulating sleeve in place.

This method results in a neat-looking transformer, with the primary leads exiting in a radial plane. The disadvantages of this method are mainly that all taping must be done carefully, and inspection is impossible after the secondary winding has been added. Careless taping may pass the initial short time period high leakage testing, but inadequate creepage distance can not be detected. Thus, it is likely that insulation will breakdown at a later time due to inadequate creepage distance.

FIG. 2 illustrates a second approach for assuring high creepage distance between the primary and secondary windings in the region where the leads penetrate the insulation. In FIG. 2, after a first layer of insulating material has been wrapped around the primary windings, an insulation sleeve, with lead wires positioned therein, is folded over and and wrapped under a second layer of insulating material as shown in FIG. 2(*a*). This approach, while effectively achieving high creepage distance, results in a bulging toroidal transformer having a bump on the perimeter of the primary winding as illustrated in FIG. 2(*b*).

Thus, improvements in insulating the primary winding lead wire from the secondary winding are necessary to obtain an improved transformer which is easier to manufacture than conventional toroidal transformers, has the appropriate creepage distance, and has a high relability factor.

SUMMARY OF THE INVENTION

Accordingly, one object of this invention is to provide a toroidal power transformer with high creepage distance.

Another object of this invention is to provide a toroidal power transformer capable of being easily manufactured.

A further object of this invention is provide a toroidal power transformer wherein the lead in wires of the primary winding are led radially away from the primary winding.

Still a further object of this invention is to provide a reliable toroidal power transformer having highly matched primary and secondary windings.

In accordance with the present invention, the foregoing and other objects are achieved by a toroidal power transformer having a primary and a secondary winding and comprising a toroidal shaped core; a primary winding wound about the core and having primary lead wires; a sleeve insulator means for housing the primary lead wires, for positioning the primary lead wires radially out from the primary windings and for providing creepage distance between the primary winding and the secondary winding; an insulator layer for covering the primary winding and for covering a portion of the sleeve insulator means; and a secondary winding wound about the insulator layer and above a portion of the sleeve insulator means and having secondary lead wires.

BRIEF DESCRIPTION OF THE DRAWINGS

The accompanying drawings, which are incorporated in and constituted part of the specification, illustrate an embodiment of the invention and, together with the description, serve to explain the principles of the invention.

DESCRIPTION OF THE PREFERRED EMBODIMENT

Figure 5:
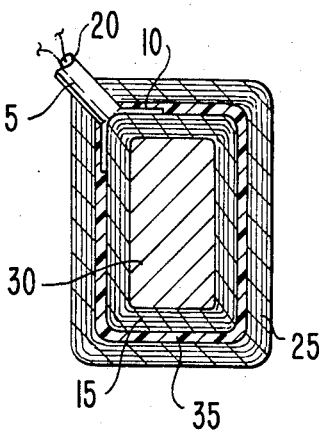
FIG. 5 is a cross-sectional view of the toroidal power transformer of FIG. 4 taken along the line 5—5 in FIG. 4.
Figure 4:
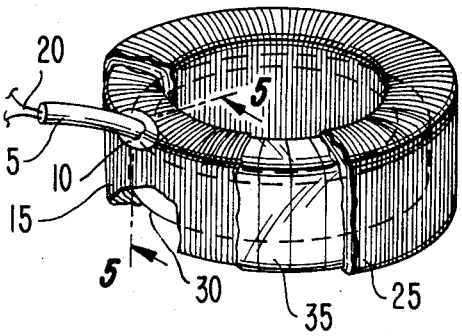
FIG. 4 is an isometric, sectional view of the toroidal power transformer of FIG. 3*a* in accordance with the present invention incorporating the insulating sleeve.

In a preferred embodiment of the present invention, such as illustrated in FIGS. 4 and 5, a toroidal power transformer comprises a toroidal shaped core 30 and a primary winding 15 wound about the core 30. The primary winding 15 has primary lead wires 20. An insulator layer 35 covers the primary winding together with a sleeve insulator means 1. A secondary winding 25 is wound about the primary winding such that the insulator layer is sandwiched between the primary and secondary windings, as shown in FIGS. 4 and 5.

Figure 2A:
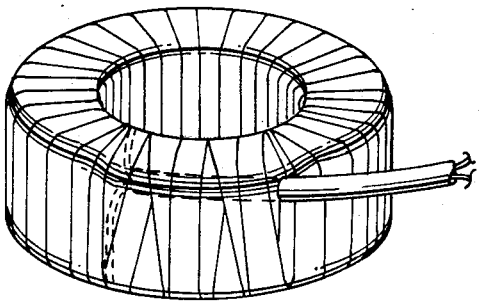
FIG. 2a (PRIOR ART)
FIG. 2*a* is an isometric view of a second conventional approach for insulating primary winding lead wires from the secondary winding in a toroidal transformer.
Figure 3A:
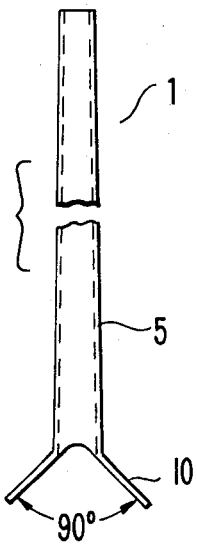
FIG. 3*a* is a side view of the insulating sleeve for a toroidal power transformer in accordance with the present invention.
Figure 3B:
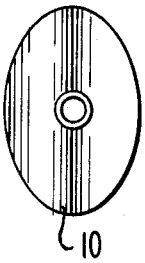
FIG. 3*b* is an end view of the insulating sleeve for a toroidal power transformer in accordance with the present invention.

FIGS. 3(*a*) and 3(*b*), respectively, illustrate side and end views of an embodiment of the sleeve insulator means 1 of the present invention. As illustrated in FIG. 3(*a*), the sleeve insulator means 1 comprises a sleeve portion 5 and a flange end portion 10. The flange portion 10 has a first opening 40 and a second opening 45. The first opening 40 of the flange portion 10 being an integral part of the sleeve portion. FIG. 3(*b*) illustrates the eliptical shape of flange portion 10. The eliptical shape permits the flange portion 10 to fit snuggly on the primary winding 15 so that the flange portion 10 follows the contours of the primary winding 15, as shown in FIG. 5. In this position, the sleeve portion 5 houses the primary lead wires 20, so that the lead wires extend substantially radially from the primary winding 15. Also, because the flange portion 10 of the insulator sleeve means 1 conforms to the contour of the primary winding 15, the secondary winding 25 does not have the odd shape due to the bulge as in the prior art transformer depicted in FIGS. 2(*a*) and 2(*b*).

In the preferred embodiment and as illustrated in FIGS. 4 and 5, the toroidal power transformer of the present invention comprises the insulator layer 35. As illustrated, the insulator layer 35 comprises, for example, a polyester film wound about the primary winding 15. The polyester film has a thickness of approximately 0.002 inches and is wound so as to provide at least two layers of insulation.

As shown in FIG. 5, the insulator layer 35 covers the flange portion 10 so that the combination of the flange portion 10 with the insulator layer 35 completely covers the primary winding. Also, because the insulator sleeve means 1 houses the primary lead wires 20, the insulator layer 35 and the sleeve insulator means 1 provide insulation for both the primary lead wires 20 and the primary winding 15. Consequently, the appropriate creepage distance (typically $\frac{3}{8}$ inch) for the power transformer of the present invention is automatically maintained in the region where the primary lead wires penetrate the insulator layer 35. In addition to automatically providing the appropriate creepage distance, the combination of insulator layer 35 and flange portion 10 of sleeve insulator means 1 maximizes the creepage distance in the region where the primary lead wires penetrate the insulator layer 35. Referring to FIG. 5, the creepage distance is maximized because any current flowing between the primary winding 15 and the secondary winding 25 must pass over both the insulator layer 35 and the flange portion 10.

Another feature of the present invention is that the radial position of the primary lead wires 10 enables the secondary winding 25 to be wound about the primary winding 15, such that the secondary winding covers substantially all of the primary winding. Consequently, the primary and secondary windings are matched.

As illustrated in FIGS. 4 and 5, the preferred location for the insulator sleeve means 1 of the present invention is on the corner of the primary winding. Referring to FIG. 3(*a*), the walls of the flange portion 10 are angularly spaced by approximately 90°, measured along the minor axis of the eliptical shape of the flange. This angular spacing permits the flange portion 10, as noted above, to fit snuggly on the primary winding 15. As a result, the perimeter of the primary winding is substantially circular. Because the primary winding is substantially circular, the toroidal power transformer of the present invention can be more easily manufactured, resulting in a more precise and better quality power transformer.

Figure 1:
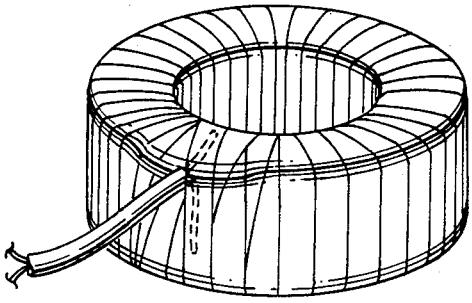
FIG. 1. (PRIOR ART)
FIG. 1 is an isometric view of a first conventional approach for insulating primary winding lead wires from a secondary winding in a toroidal transformer.
Figure 2B:
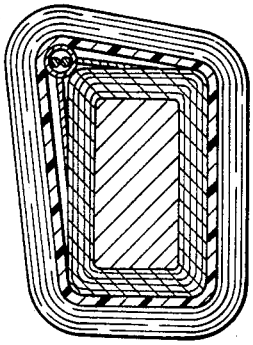
FIG. 2b. (PRIOR ART)
FIG. 2*b* is a cross-sectional view of the toroidal power transformer of FIG. 2*a* along the line 2—2 in FIG. 2*a;*

In short, the toroidal power transformer of the present invention is easy to manufacture because it avoids the irregular shape of the toroidal power transformer shown in FIGS. 2(*a*) and (*b*), is more reliable than conventional toroidal power transformers because it avoids manufacturing errors occurring in the transformer of FIG. 1, and automatically achieves a proper creepage distance due to installing the insulating layer 35 on the flange portion 10 of the insulator sleeve means 1 and on the primary winding 15 as illustrated in FIG. 5. Thus, the present invention avoids the potential errors occurring in hand wrapping an insulation tape on the primary winding as is done in the manufacture of the prior art toroidal power transformer of FIG. 1.

In view of the foregoing, it can be seen that it is intended that the present invention cover the modifications and variations of the toroidal power transformer of the present invention and not limited to the preferred embodiment discussed herein, but are defined by the appended claims and their equivalents.

What is claimed is:

1. A toroidal power transformer having a primary and a secondary winding and comprising:

a toroidal shaped core;

a primary winding wound about said core, having primary lead wires, and having an annular end surface and a cylindrical side surface forming a shoulder therebetween;

sleeve insulator means, having a tube portion and having a flange portion connected to the tube portion with no gaps therebetween and formed continuously about the tube portion such that the flange portion conformingly and continuously covers part of the annular end surface, part of the cylindrical side surface and part of the shoulder in the region around said primary lead wires, for housing said primary lead wires, for positioning said primary lead wires outward from said primary winding and for providing creepage distance between said primary winding and said secondary winding in said region around said primary lead wires;

a wrapped insulator, overlappingly wrapped around said primary winding and said flange portion of said sleeve insulator means; and said secondary winding wound about said wrapped insulator and above said flange portion of said sleeve insulator means and having secondary lead wires.

2. A toroidal power transformer according to claim 1, wherein said tubular portion and said flange portion are formed of a single piece of material.

3. A toroidal power transformer according to claim 1, wherein said creepage distance is a minimum of $\frac{3}{8}$ inch.

4. A toroidal power transfomer according to claim 2, wherein said creepage distance is a minimum of $\frac{3}{8}$ inch.

* * * * *